US010378541B2

(12) United States Patent
Ignatiev et al.

(10) Patent No.: US 10,378,541 B2
(45) **Date of Patent: *Aug. 13, 2019**

(54) COMPRESSOR WITH OIL PUMP ASSEMBLY

(71) Applicant: Emerson Climate Technologies, Inc., Sidney, OH (US)

(72) Inventors: Kirill M. Ignatiev, Sidney, OH (US); Michael M. Perevozchikov, Tipp City, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/948,760

(22) Filed: Apr. 9, 2018

(65) Prior Publication Data

US 2018/0223851 A1 Aug. 9, 2018

Related U.S. Application Data

(63) Continuation of application No. 14/994,352, filed on Jan. 13, 2016, now Pat. No. 9,938,977.

(Continued)

(51) Int. Cl.

| | |
|---|---|
| ***F04C 29/02*** | (2006.01) |
| ***F04C 18/02*** | (2006.01) |
| ***F04C 23/00*** | (2006.01) |

(52) U.S. Cl.

CPC ..... *F04C 29/025* (2013.01); *F04C 18/0215* (2013.01); *F04C 23/008* (2013.01)

(58) Field of Classification Search

CPC .. F04C 29/025; F04C 29/023; F04C 15/0088; F04C 2/34–46; F04C 15/06;

(Continued)

(56) References Cited

U.S. PATENT DOCUMENTS 3,273,501 A * 9/1966 Tothero ..... F04C 14/04 418/166
4,209,080 A * 6/1980 Douglas ..... F04B 39/0246 184/6.16

(Continued)

FOREIGN PATENT DOCUMENTS

CN 104105878 A 10/2014
JP H0412194 1/1992

(Continued)

OTHER PUBLICATIONS

Non-Final Office Action regarding International Patent Application No. PCT/US2016/016178, dated Jul. 27, 2018.

(Continued)

*Primary Examiner* — Charles G Freay
*Assistant Examiner* — Thomas Fink
(74) *Attorney, Agent, or Firm* — Harness, Dickey & Pierce, P.L.C.

(57) ABSTRACT

A compressor is provided and may include a shell, a motor assembly, a compression mechanism, a pump housing, and at least one pump. The shell includes a fluid disposed therein. The motor assembly is disposed within the shell and is drivingly engaged with a driveshaft. The compression mechanism is driven by the driveshaft. The pump housing is rotatably disposed within the shell for rotation relative to the driveshaft and relative to the shell. The at least one pump is rotatably disposed within the pump housing such that the at least one pump is in driving engagement with the driveshaft.

20 Claims, 4 Drawing Sheets

Related U.S. Application Data

(60) Provisional application No. 62/111,344, filed on Feb. 3, 2015.

(58) Field of Classification Search
CPC .. F04C 29/12; F04B 39/0246; F04B 39/0261; F04B 53/18; F16N 13/20; F01M 1/02; F01M 2001/0238; F01C 21/04; F04D 29/406; F04D 29/605
USPC ..... 418/88, 94, 96; 417/460–462, 464
See application file for complete search history.

(56) References Cited

U.S. PATENT DOCUMENTS 4,449,895 A * 5/1984 Kurahayashi ..... F04C 29/025 184/31
4,456,437 A * 6/1984 Kurahayashi ..... F04B 39/0246 184/6.16
4,564,339 A * 1/1986 Nakamura ..... F04C 29/023 310/57
4,747,471 A * 5/1988 Ballentine ..... F04B 39/0246 184/6.18
4,750,864 A * 6/1988 Bayyouk ..... F04B 39/0246 184/31
5,326,239 A * 7/1994 Fujiwara ..... F04C 18/107 418/220
5,375,986 A * 12/1994 Ukai ..... F04C 2/04 418/235
5,377,781 A * 1/1995 Yun ..... F04B 39/0246 184/6.23
5,505,596 A * 4/1996 Nakamura ..... F01C 21/102 184/6.18
5,542,266 A * 8/1996 Suzuki ..... F04B 39/0215 62/469
5,803,718 A * 9/1998 Woo ..... F04B 39/0246 184/6.16
5,842,420 A * 12/1998 Khoo ..... F04B 39/0246 184/6.16
6,167,719 B1 * 1/2001 Yakumaru ..... F04C 23/008 62/193
6,182,794 B1 * 2/2001 Lee ..... F04B 39/0253 184/6.18
6,484,846 B1 * 11/2002 Parker ..... F04B 39/0253 184/6.16
6,666,301 B2 * 12/2003 Kim ..... F04B 39/0246 184/6.16
6,684,979 B1 * 2/2004 Nakazato ..... F04B 39/0027 184/6.16
2002/0170779 A1 * 11/2002 Kim ..... F04B 39/0246 184/6.18
2005/0180871 A1 * 8/2005 Ohtahara ..... F04B 39/0253 417/502
2006/0045784 A1 * 3/2006 Grassbaugh ..... F04C 29/025 418/55.6
2006/0222551 A1 * 10/2006 Jung ..... F04C 18/0215 418/55.6
2008/0170955 A1 7/2008 Eber et al.
2011/0150690 A1 * 6/2011 Tang ..... F04C 18/0215 418/55.6
2013/0156612 A1 * 6/2013 Bonnefoi ..... F04C 29/021 417/212
2013/0287603 A1 * 10/2013 Park ..... F04B 39/023 417/410.1

FOREIGN PATENT DOCUMENTS

KR 20030010963 A 2/2003
WO WO-9317241 A1 9/1993

OTHER PUBLICATIONS

Non-Final Office Action regarding International Patent Application No. PCT/US2016/016178, dated Aug. 7, 2018.
Non-Final Office Action regarding International Patent Application No. PCT/US2016/016178, dated Jan. 4, 2019.
Written Opinion of the International Searching Authority regarding International Application No. PCT/US2016/016178, dated Apr. 22, 2016.
Internatiional Search Report regarding International Application No. PCT/US2016/016178, dated Apr. 22, 2016.

* cited by examiner

COMPRESSOR WITH OIL PUMP ASSEMBLY

CROSS-REFERENCE TO RELATED APPLICATIONS

This application is a continuation of U.S. patent application Ser. No. 14/994,352 filed on Jan. 13, 2016. This application claims the benefit of U.S. Provisional Application No. 62/111,344, filed on Feb. 3, 2015. The entire disclosure of each of the above applications is incorporated herein by reference.

FIELD

The present disclosure relates to a compressor, and more particularly to an oil pump assembly of a compressor.

BACKGROUND

This section provides background information related to the present disclosure and is not necessarily prior art.

Compressors are used in applications such as refrigeration systems, air conditioning systems, and heat pump systems to pressurize and, thus, circulate refrigerant within each system.

As a compressor operates, a motor typically rotates a driveshaft, which in turn drives a compression mechanism (e.g., scrolls, pistons, screw, etc.) to compress a volume of fluid (e.g., air, refrigerant, etc.). For example, as a scroll compressor operates, the driveshaft drives an orbiting scroll member having an orbiting scroll member wrap, such that the orbiting scroll orbits with respect to a non-orbiting scroll member having a non-orbiting scroll member wrap. The orbiting and non-orbiting scroll member wraps cooperatively define moving pockets of vapor refrigerant.

The driveshaft may additionally drive a pump that is configured to pump a fluid (e.g., a lubricant, such as oil) to various parts and components of the compressor. Often the driveshaft is supported by a bearing structure or assembly that is fixed to, or otherwise supported by, a shell or housing of the compressor. For example, the bearing assembly may be coupled to, or otherwise rotatably support, an end of the driveshaft. As the driveshaft rotates within the bearing assembly, it can drive the lubricant pump, which can in turn supply lubricant to the moving parts of the compressor. Effective operation of the lubricant pump is desirable to ensure that the compressor is capable of efficiently providing a cooling and/or heating effect on demand and over long periods of time without overheating or otherwise damaging the moving components in the compressor. The lubricant pump can be attached to, or integrally part of, the bearing assembly. In this regard, the lubricant pump often includes a stationary member or pump housing and a moving member or pumping mechanism. The stationary member can be coupled to the bearing assembly and/or the shell of the compressor, and the moving member can move (e.g., rotate) within or otherwise relative to the stationary member to effectively generate a pumping action. If the relative rotation between the pump housing and the actuator member is compromised or diminished, the pump may fail to effectively and efficiently lubricate the compressor.

SUMMARY

This section provides a general summary of the disclosure, and is not a comprehensive disclosure of its full scope or all of its features.

A compressor constructed in accordance with one example of the present disclosure can include a shell, a motor assembly, a compression mechanism, a pump housing, and at least one pump. The shell includes a fluid disposed therein. The motor assembly is disposed within the shell and is drivingly engaged with a driveshaft. The compression mechanism is driven by the driveshaft. The pump housing is rotatably disposed within the shell for rotation relative to the driveshaft and relative to the shell. The at least one pump is rotatably disposed within the pump housing such that the at least one pump is in driving engagement with the driveshaft.

In some configurations, a radially extending portion may extend outwardly from the pump housing.

In some configurations, the radially extending portion may be at least partially disposed within the fluid.

In some configurations, the at least one pump may apply a first torque on the pump housing in a first direction, and the fluid may apply a second torque on the pump housing in a second direction, the second direction being opposite the first direction.

In some configurations, the pump housing may not be supported by the shell.

In some configurations, the motor assembly may include a flange disposed annularly about the driveshaft and supported by the motor assembly.

In some configurations, the flange may include an axially extending portion and a radially inwardly extending portion.

A compressor constructed in accordance with another example of the present disclosure can include a shell, a motor assembly, a driveshaft, a compression mechanism, a pump housing, and a pump. The motor assembly may be disposed within the shell. The driveshaft may be drivingly engaged with the motor assembly. The compression mechanism may be driven by the driveshaft. The pump housing may be rotatably supported by the driveshaft for rotation relative to the driveshaft and relative to the shell. The pump may be disposed within the pump housing and in driving engagement with the driveshaft.

A compressor constructed in accordance with yet another example of the present disclosure can include a shell, a motor assembly, a driveshaft, a pump assembly, a conduit, and a mass. The motor assembly may be disposed within the shell. The driveshaft may be drivingly engaged with the motor assembly. The pump assembly may include a pump housing disposed within the shell and supported by the driveshaft, where the driveshaft may be rotatable relative to the pump housing and relative to the shell. The conduit may include a first end and a second end, where the first end may be coupled to the pump assembly. The mass may be supported by the conduit near the second end.

In some configurations, lubricant may be disposed within an interior of the shell, and the second end of the conduit may be in fluid communication with the lubricant.

In some configurations, a sump may house the lubricant, and the second end of the conduit may be in fluid communication with an interior of the sump.

In some configurations, when the compressor is rotated such that an axis extending a length of the driveshaft defines an angle with a horizontal plane, gravity acts on the mass, urging the second end of the conduit toward a lowest location within the shell, such that the second end of the conduit remains in fluid communication with the lubricant.

In some configurations, when the compressor is rotated such that an axis extending a length of the driveshaft defines a first angle with a horizontal plane, gravity acts on the mass, urging a portion of the conduit in a vertical configuration such that the portion of the conduit forms a second angle with the axis extending the length of the driveshaft.

In some configurations, when the conduit is in the vertical configuration, the second end of the conduit is in fluid communication with the lubricant such that the pump assembly moves the lubricant from the interior of the shell, through the conduit and the pump assembly, and into a passageway in the driveshaft.

In some configurations, the second angle may be equal to ninety degrees less the first angle.

In some configurations, the conduit may be flexible along its length.

In some configurations, the conduit may include a hinged portion permitting one portion of the conduit to pivot relative to another portion of the conduit.

In some configurations, the mass may include an aperture, and the second end of the conduit may be inserted within the aperture and secured thereto.

In some configurations, the driveshaft may be rotatable within the pump housing.

In some configurations, the mass may be formed of metal.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Example embodiments will now be described more fully with reference to the accompanying drawings. Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

Figure 1:
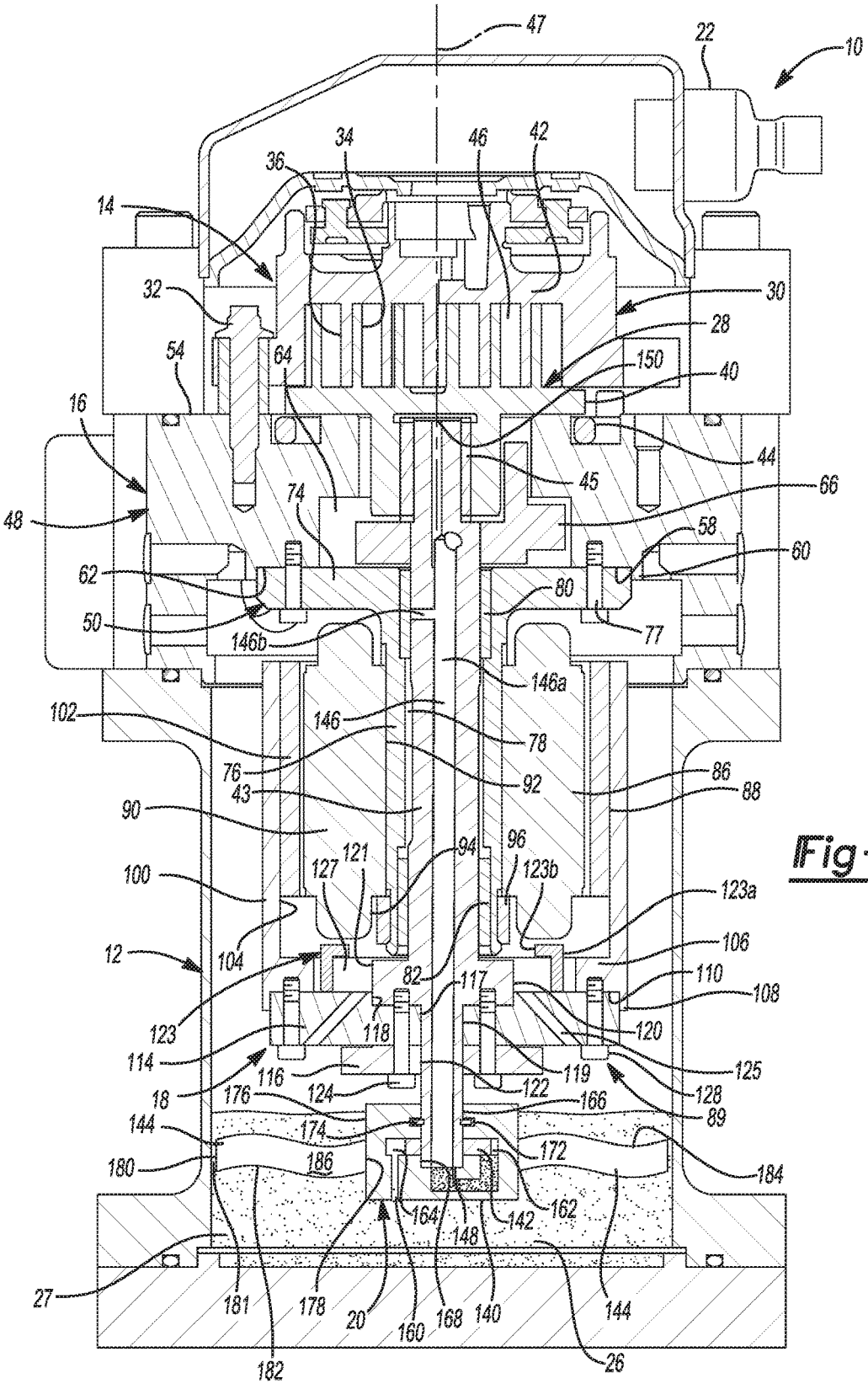
FIG. 1 is a cross-sectional view of a compressor including a pump assembly in accordance with the principles of the present disclosure.

With reference to FIG. 1, a compressor 10 is shown to include a shell assembly 12, a compression mechanism 14, a bearing housing assembly 16, a motor assembly 18, and a pump assembly 20. While the present disclosure is suitable for incorporation in many different types of scroll machines, including hermetic machines, open drive machines and non-hermetic machines, for exemplary purposes it will be described herein incorporated in a semi-hermetic scroll refrigerant motor-compressor 10 of the "low side" type (i.e., where the motor and compressor are cooled by suction gas in the hermetical shell, as illustrated in the vertical section shown in FIG. 1).

The shell assembly 12 may house the motor assembly 18, the compression mechanism 14, and the bearing housing assembly 16. The shell assembly 12 may include a suction inlet port (not shown) receiving a working fluid at a suction pressure from one of an indoor and outdoor heat exchanger (not shown) and a discharge outlet port 22 discharging the working fluid to the other of the indoor and outdoor heat exchanger after it has been compressed by the compression mechanism 14. A discharge valve (not shown) may allow compressed fluid to flow from the compression mechanism 14 to the discharge outlet port 22 and may restrict or prevent fluid-flow from the discharge outlet port 22 to the compression mechanism 14. A bottom portion of the shell assembly 12 may form a reservoir or sump 26 containing a volume of a lubricant 27 (e.g., oil).

The compression mechanism 14 may include an orbiting scroll member 28 and a non-orbiting scroll member 30. The non-orbiting scroll member 30 may be fixed to the bearing housing assembly 16 by a plurality of fasteners 32, such as threaded bolts or similar attachment features. The orbiting and non-orbiting scroll members 28, 30 include orbiting and non-orbiting spiral wraps 34, 36, respectively, that meshingly engage each other and extend from orbiting and non-orbiting end plates 40, 42, respectively.

A driveshaft 43 may rotatably engage the orbiting scroll member 28, via a bushing 45, to cause orbital movement of the orbiting scroll member 28 relative to the non-orbiting scroll member 30 as the driveshaft 43 rotates about an axis 47.

An Oldham coupling 44 may be keyed to the orbiting scroll member 28 and a stationary structure (e.g., the bearing housing assembly 16 or the non-orbiting scroll member 30) to prevent relative rotation between the orbiting and non-orbiting scroll members 28, 30 while allowing the orbiting scroll member 28 to move in an orbital path relative to the non-orbiting scroll member 30. Moving fluid pockets 46 are formed between the orbiting and non-orbiting spiral wraps 34, 36 that decrease in size as they move from a radially outer position to a radially inner position, thereby compressing the working fluid therein from the suction pressure to the discharge pressure.

The bearing housing assembly 16 may include a first or upper housing 48 and a second or lower housing 50. The upper housing 48 may include a first or upper side 54 and a second or lower side 58. The upper side 54 may be disposed adjacent to the orbiting scroll member 28. The lower side 58 of the upper housing 48 may include an annular flange 60. The annular flange 60 may extend axially from the lower side 58 to define a recess 62. The upper housing 48 may define a counterweight cavity 64 between the upper and lower sides 54, 58. A counterweight 66, coupled to the driveshaft 43, may rotate within the counterweight cavity 64.

The lower housing 50 may include a flange or plate portion 74 and a shaft or rotor support portion 76. The plate portion 74 may be integrally formed with the rotor support portion 76, such that the lower housing 50 is a monolithic construct. The plate portion 74 may be at least partially disposed and secured within the recess 62 of the upper housing 48. In this regard, in one configuration, a plurality of bolts 77 or other suitable mechanical fasteners may be used to couple the lower housing 50 to the upper housing 48. It will be appreciate, however, that the lower housing 50 may be coupled to the upper housing 48 using other techniques, such as welding or press-fitting the plate portion 74 within the recess 62, for example. The rotor support portion 76 may include a generally tubular construct extending axially from the plate portion 74. In this regard, the lower housing 50 may define an aperture 78 extending axially through the plate and rotor support portions 74, 76 of the second housing. The aperture 78 may house and support a first or upper bearing 80 and a second or lower bearing 82, which rotatably support the driveshaft 43.

The motor assembly 18 may include a motor stator 86, a rotor 88, and a rotor support subassembly 89. In some configurations, the motor assembly 18 may include an induction motor. In other configurations, the motor assembly 18 may include a switched reluctance motor. In other configurations, the motor stator 86 may be of a segmented stator design where the segments of the motor stator 86 may interlock to help prevent the stator 86 from disassembling during assembly and operation of the compressor 10. In this regard, in some configurations, the motor stator 86 may include a plurality of wire-wound radially extending poles 90. The radially extending poles 90 may define an axially extending aperture 92 therethrough. The aperture 92 may receive the rotor support portion 76 of the lower housing 50, such that the motor stator 86 may be coupled to the lower housing 50. In one configuration, the motor stator 86 may be press-fit over the rotor support portion 76. In other configurations, a lower end of the aperture 92 may include a key slot or portion 94 sized to receive a support member 96, such as a hexagonal nut. In this regard, a lower end of the rotor support portion 76 may threadably engage the support member 96 to secure the motor stator 86 to the rotor support portion 76. It will be also be appreciated that the motor stator 86 may be secured to the rotor support portion 76 using other techniques, such as press-fitting or threaded engagement. The use of the rotor support portion 76 for both securing the motor stator 86 and securing the bearings 80, 82 can improve the alignment of the motor assembly 18 relative to the driveshaft 43 and the axis 47.

In some configurations, the rotor 88 may be disposed about the motor stator 86 and coupled to the driveshaft 43. In this regard, the rotor 88 may be annularly disposed between the motor stator 86 and the shell assembly 12. In other configurations, the motor stator 86 may be disposed about the rotor 88. In either configuration, the driveshaft 43 may be coupled to, or otherwise supported by, the rotor 88 for rotation therewith. In this regard, the rotor 88 may transmit rotational power to the driveshaft 43.

The rotor 88 may include a housing 100 and a plurality of magnets 102. The housing 100 may include a generally cylindrical construct defining a cylindrical inner surface 104. The magnets 102 may be coupled to, and supported by, the inner surface 104. The centripetal forces generated by the rotor 88 may help to secure the magnets 102 to the inner surface 104. In this regard, in some configurations the magnets 102 may be secured to the inner surface using only an adhesive. In one configuration, the magnets 102 may be ferrite permanent magnets. The motor stator 86 may be concentrically disposed within the housing 100 and the magnets 102.

A flange 106 may extend radially inwardly from the inner surface 104 of the housing 100. In one configuration, the flange 106 may extend annularly about the inner surface 104, such that the flange 106 at least partially defines an axially extending lip portion 108 of the housing 100. The flange 106 and the lip portion 108 may at least partially define a recess 110.

The rotor support subassembly 89 may include a first or upper support member or plate 114 and a second or lower support member or plate 116. The upper support plate 114 may include a generally disk-shaped member defining a bore or aperture 117 therethrough, and a counterbore or recess 118. As illustrated, the aperture 117 may be concentrically formed relative to the recess 118. In an assembled configuration, the driveshaft 43 may be disposed within the aperture 117. The driveshaft 43 may include a first outer surface 119 and a second outer surface 121. The second outer surface 121 may extend radially outwardly relative to the first outer surface 119, such that the second outer surface 121 includes a radially extending portion 120 that can be disposed within the recess 118. As illustrated in FIG. 1, in some configurations, the radially extending portion 120 may define a stepped or flanged portion 120 of the driveshaft.

The rotor support subassembly 89 may further include a flange or lubricant retention member 123 and a lubricant drain 125. As illustrated, the lubricant retention member 123 may extend from the upper support plate 114 and substantially surround, or otherwise extend circumferentially about, the driveshaft 43. The lubricant retention member 123 may include a first or axially extending portion **123*a* and a second or radially extending portion 123*b*. The axially extending portion 123*a* may extend from, and be coupled to, the upper support plate 114, and the radially extending portion 123*b* may extend radially inwardly from, and be coupled to, the vertically extending portion 123*a*, such that the driveshaft 43, the upper support plate 114, and/or the lubricant retention member 123 define a lubricant reservoir 127. The lubricant retention member 123 may define a height extending from the upper support plate 114, such that the lubricant retention member 123 is aligned with, or otherwise overlaps, the rotor support portion 76 of the lower housing 50**.

During operation of the compressor 10, lubricant 27 that is pumped through the driveshaft 43 may thereafter drain or otherwise travel from the compression mechanism 14 and/or the motor assembly 18 to the lubricant reservoir 127. For example, the lubricant 27 may flow between the rotor support portion 76 and the driveshaft 43, and into the lubricant reservoir 127. The lubricant retention member 123 can help to contain the lubricant 27 within the lubricant reservoir 127 and prevent the lubricant 27 from contacting the magnets 102 or other portions of the rotor 88. In this regard, the height of the lubricant retention member 123, including the overlapping or otherwise aligned configuration of the lubricant retention member 123 and the rotor support portion 76, can help to contain the lubricant 27 within the lubricant reservoir 127. Lubricant 27 that has accumulated in the lubricant reservoir 127 can flow through the lubricant drain 125 and into the sump 26. The lubricant drain 125 may include a plurality of holes or apertures 125 extending through the upper support plate 114. As illustrated, the apertures 125 may be formed at an angle relative to the axis 47 (i.e., radially outwardly in a downwardly extending direction relative to the view in FIG. 1), such that a centrifugal force generated by the rotation of the rotor 88 and the upper support plate 114 urges the lubricant 27 through the apertures 125 and into the sump 26.

The lower support plate 116 may include a generally disk-shaped member (e.g., a washer) defining an aperture 122 therethrough. In an assembled configuration, the aperture 122 may be concentrically aligned with the aperture 117. Accordingly, the driveshaft 43 may be disposed within the aperture 122 and the aperture 117. In this regard, the lower support plate 116 may be eccentrically disposed about the driveshaft 43, or constructed in such a way that the lower support plate 116 acts as a counterweight upon rotation of the driveshaft 43.

The rotor support subassembly 89 may be secured to the driveshaft 43 using various techniques. In one configuration, a plurality of fasteners 124 (e.g., bolts) may extend through the lower support plate 116, the upper support plate 114, and the radially extending portion 120 of the driveshaft 43 to prevent axial movement of the rotor support subassembly 89 relative to the driveshaft 43, and allow the driveshaft to rotate with the rotor support subassembly 89. In other configurations, the rotor support subassembly 89, including the upper and/or lower support plates 114, 116 may be press-fit onto the driveshaft 43. For example, the driveshaft 43 may be press-fit into the aperture 117 and/or the aperture 122 of the upper and/or lower support plates 114, 116, respectively. Similarly, the radially extending portion 120 may be press-fit into the recess 118 of the upper support plate 114.

The rotor support subassembly 89 and the driveshaft 43 may be further fixed for rotation with the rotor 88. The rotor support subassembly 89 may be secured to the rotor 88 using various techniques. In one configuration, a plurality of fasteners 128 (e.g., bolts) may extend through the upper support plate 114 and the flange 106 of the housing 100. In other configurations, the upper support plate 114 may be press-fit into the housing 100. For example, the upper support plate 114 may be press-fit into the recess 110, such that the upper support plate 114 engages the lip portion 108 of the housing. Securing the rotor support subassembly 89 to the rotor 88 and the driveshaft 43 ensures that when power is supplied to the motor assembly 18, the rotor 88 may transmit rotational power, or drive torque, to the rotor support subassembly 89 and the driveshaft 43.

The configuration of the motor assembly 18, the rotor support portion 76, and the rotor support subassembly 89 can simplify the process of assembling the compressor 10. In this regard, the motor assembly 18 and the rotor support subassembly 89 can be pre-assembled and/or secured to the rotor support portion 76, before securing the lower housing 50 to the upper housing 48, and before securing the upper housing 48 to the shell assembly 12.

Figure 2:
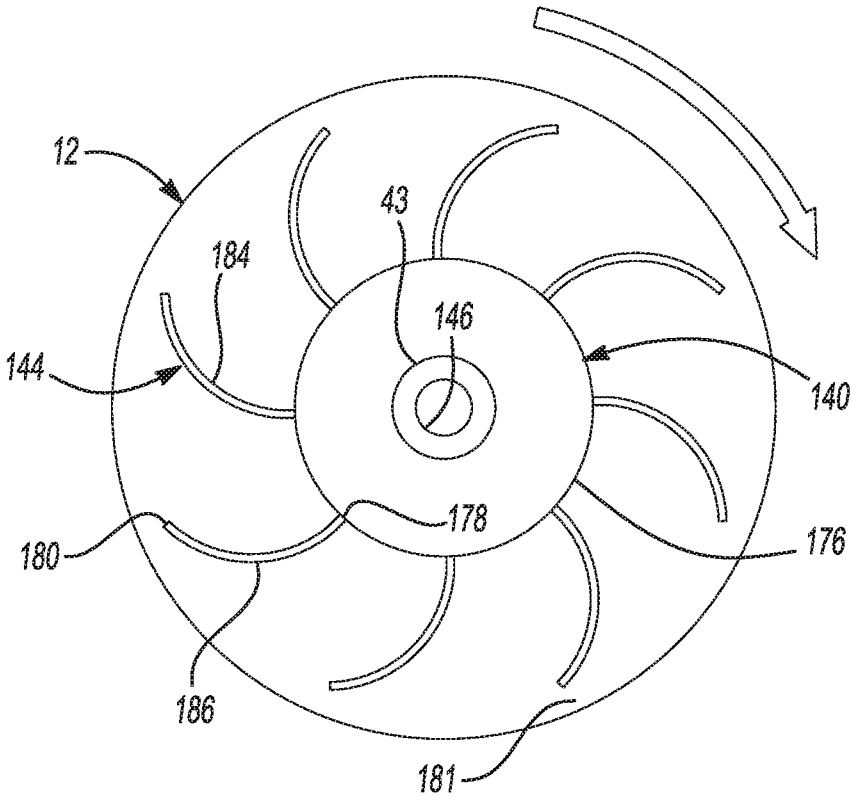
FIG. 2 is a top view of the pump assembly of FIG. 1.

With reference to FIGS. 1 and 2, the pump assembly 20 may include a housing 140, a pumping mechanism 142, and a drag feature or member 144. The pump assembly 20 may include various configurations of a hydraulic pump, including, by way of example only, a gear pump, a vane pump, a gerotor pump, a screw pump, or a piston pump. Accordingly, it will be appreciated that the pumping mechanism may include various configurations and components (not shown), such as gears, screws, vanes, and/or pistons. The pump assembly 20 may be coupled to or otherwise supported by the driveshaft 43. In this regard, the driveshaft 43 may be rotatably supported by the housing 140 and coupled to the pumping mechanism 142, such that rotation of the driveshaft 43 causes the movement (e.g., rotation) of the pumping mechanism 142 within, or otherwise relative to, the housing 140.

Rotation of the pumping mechanism 142 relative to the housing 140 can pump the lubricant 27 from the sump 26 to the compression mechanism 14 and/or to the motor assembly 18. In this regard, the driveshaft 43 may include a bore or passageway 146 extending therethrough. The passageway 146 may include a first or axially extending portion **146*a* and a second or transversely extending portion 146*b*. The axially extending portion 146*a* may include a first or proximal end 148 in fluid communication with the pump assembly 20 and a second or distal end 150 adjacent to, or otherwise aligned with, the orbiting scroll member 28 and/or the bushing 45. Accordingly, it will be appreciated that the passageway 146 can supply the lubricant 27 from the pump assembly 20 to the orbiting scroll member 28 and/or the bushing 45. The transversely extending portion 146*b* may extend radially from, and be in fluid communication with, the axially extending portion 146*a*. In this regard, the transversely extending portion 146*b* may be in fluid communication with the axially extending portion 146*a*, and in fluid communication with a portion of the bearing housing assembly 16. As illustrated, the transversely extending portion 146*b* may be adjacent to, or otherwise aligned with, the upper bearing 80. Accordingly, it will be appreciated that the transversely extending portion 146*b* can supply the lubricant 27 from the axially extending portion 146*a* to the upper and/or lower bearings 80, 82**.

The housing 140 of the pump assembly 20 may include an inlet 160, an outlet 162, a chamber 164, an opening 166, and a recess 168. The inlet 160 may be in fluid communication with the sump 26 and the chamber 164. The outlet 162 may be in fluid communication with the chamber 164 and the passageway 146 of the driveshaft 43. Accordingly, during operation, the pump assembly 20 can transport, or otherwise move, the lubricant 27 from the sump 26, through the inlet 160, into the chamber 164, through the outlet 162, and into the passageway 146, where it can then be delivered to the bearings 80, 82, the bushing 45, and/or other portions of the compressor 10 in the manner described above.

The driveshaft 43 may extend through the opening 166 and into the recess 168. In this regard, it will be appreciated that the housing 140 can support the driveshaft 43 for rotation therein. As illustrated, in some configurations, the opening 166 may include a radially extending channel or groove 172 supporting a ring member 174 (e.g., a snap ring). The ring member 174 can engage the driveshaft 43 to secure the driveshaft 43 to the housing 140. It will also be appreciated that the driveshaft 43 can be secured to the housing 140 using other configurations, including a press-fit arrangement, that can secure the driveshaft 43 to the housing 140 while also allowing the housing 140 to rotate relative to the driveshaft 43.

The drag member 144 may extend outwardly from an outer surface 176 of the housing 140, or otherwise include a radially and/or axially outwardly extending portion of the housing 140. In this regard, in some configurations the outer surface 176 may include a texturing or surface roughness that includes, or otherwise defines, the drag member 144. In some configurations, the surface roughness may be defined by, but is not limited to, vertical lines, cross-hatched lines, random or patterned irregularities in the surface, or any other surface treatment that cooperates with the lubrication, and creates enough drag, to impart a rotation of the pump housing relative to the driveshaft. As illustrated, in some configurations, the pump assembly 20 may include a plurality of drag members 144. For example, as illustrated in FIG. 2, in some configurations the pump assembly may include eight equally spaced drag members 144. The drag member 144 may include a proximal end 178, a distal end 180, an inferior side or edge 182, and a superior side or edge 184. In some configurations, the drag member 144 may define a fin-shaped construct. The proximal end 178 may be coupled to or otherwise supported by the housing 140. The distal end 180 and the shell assembly 12 may define a void or gap 181 therebetween. In this regard, it will be appreciated that the pump assembly 20 may be suspended in the sump 26 (including the lubricant 27), such that the pump assembly 20 does not contact, or is otherwise not supported by, the shell assembly 12. The inferior and superior edges 182, 184 may extend from and between the proximal and distal ends 178, 180, such that the proximal and distal ends 178, 180 and the inferior and superior edges 182, 184 may collectively define an axially and radially extending surface 186.

As illustrated in FIG. 1, in some configurations the inferior and superior edges 182, 184 may define an arcuate or otherwise wavy profile in, or relative to, a vertical or axially extending direction. Further, as illustrated in FIG. 2, in some configurations the inferior and superior edges 182, 184 may define an arcuate profile in, or relative to, a horizontal or radially extending direction, such that the surface 186 includes a substantially arcuate shape. While the drag member 144 is generally shown and described as having an arcuate or wavy configuration, it will be appreciated that the drag member 144 may include other radially outwardly extending shapes and configurations within the scope of the present disclosure.

Operation of the compressor 10, including the pump assembly 20, will now be described in more detail. As explained above, the motor assembly 18 can be powered to drive the driveshaft 43. Accordingly, rotation of the rotor 88 can cause the rotation of the driveshaft 43, which can in turn cause the pumping mechanism 142 to rotate with, or orbit about, the driveshaft 43. Frictional forces between the housing 140 and the driveshaft 43 and/or the pumping mechanism 142 can generate a first torque that urges the rotation of the housing 140 in a first direction about the axis 47. As the housing 140 rotates in the first direction about the axis 47, the drag member 144 can begin to move or rotate within the lubricant 27. As the drag member 144 moves within the lubricant 27, the lubricant 27 can apply a force on the surface 186 that generates a second torque that is opposite the first torque. Accordingly, the second torque can urge the rotation of the housing 140 in a second direction, opposite the first direction, about the axis 47. Thus, it will be appreciated that the drag member 144 can operate to minimize or prevent the rotation of the housing 140 in the first direction about the axis 47, as the driveshaft 43 rotates in the first direction about the axis 47, and as the pumping mechanism 142 rotates with, or orbits about, the driveshaft 43.

Figure 3A:
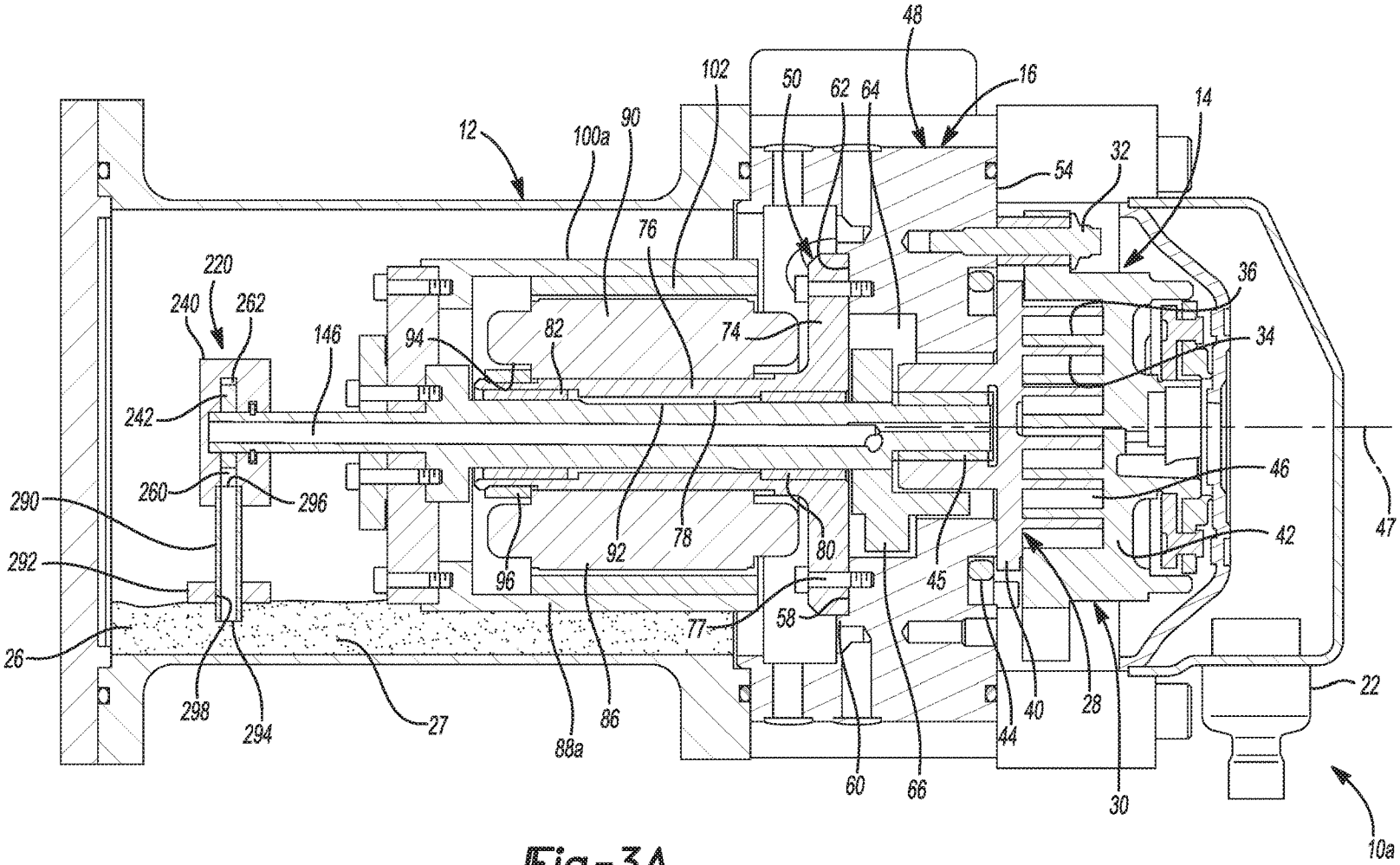
FIG. 3A is a cross-sectional view of another compressor including another pump assembly in accordance with the principles of the present disclosure, the compressor shown in a first configuration.
Figure 3B:
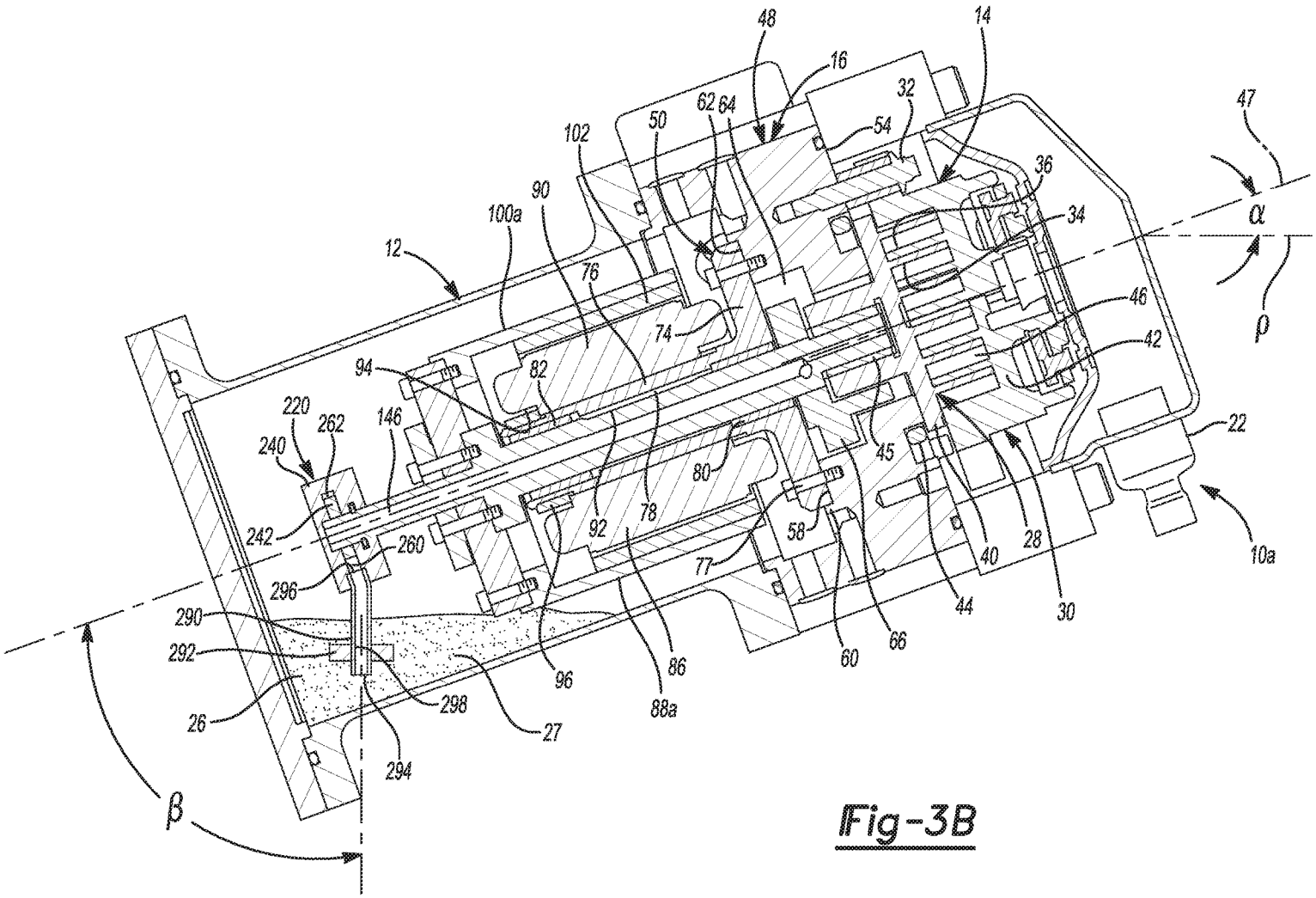
FIG. 3B is another cross-sectional view the compressor of FIG. 3A, the compressor shown in a second configuration.

With reference to FIGS. 3A and 3B, another configuration of a compressor 200 is shown. The structure and function of the compressor 200 may be substantially similar to that of the compressor 10 illustrated in FIG. 1, apart from any exceptions described below and/or shown in the figures. Therefore, the structure and/or function of similar features will not be described again in detail. Furthermore, like reference numerals may be used to describe like features and components, while like reference numerals beginning with a "2_" may be used to identify those components that have been modified.

The compressor 200 may include a pump assembly 220. The pump assembly 220 may be substantially similar to the pump assembly 20 apart from any exceptions described below and/or shown in the figures. In this regard, the pump assembly 220 may include a housing 240, a pumping mechanism 242, a conduit 290, and a rotation restricting device 292. The housing 240 of the pump assembly 220 may include an inlet 260 and an outlet 262, and may be fixed relative to the shell assembly 12, such that the driveshaft 43 is rotatable within, or otherwise relative to, the housing 240.

In some configurations, the conduit 290 may include a generally flexible construct extending between a distal end 294 and a proximal end 296. In other configurations, the conduit 290 may include a generally rigid or stiff construct extending between the distal end 294 and the proximal end 296. The proximal end 296 of the conduit 290 may be coupled to, or otherwise in fluid communication with, the sump 26 and/or a lower portion (relative to the views in FIGS. 3A and 3B) of the shell assembly 12. The distal end 294 of the conduit 290 may be coupled to, or otherwise in fluid communication with, the inlet 260 of the pump assembly 220.

The rotation restricting device 292 may include a load or mass removably coupled to the distal end 294 of the conduit 290. In this regard, the rotation restricting device 292 may include an anchor, such as a weight member, for example. The rotation restricting device 292 may include a through hole or aperture 298. The distal end 294 of the conduit 290 may be disposed and secured within the aperture 298 using adhesives, welding, mechanical fasteners, a press-fit configuration, and/or other suitable fastening techniques. The rotation restricting device 292 may be constructed from metal (e.g., steel) or another suitable material having a sufficient mass such that gravity urges the rotation restricting device 292, and thus the distal end 294 of the conduit 290, to the lowest (relative to the views in FIGS. 3A and 3B) location in the shell assembly 12. The flexible construct of the conduit 290 can allow the conduit 290 to bend or flex in response to the effect of gravity on the rotation restricting device 292 and/or the conduit 290. It will be appreciated that while the conduit 290 is illustrated and described herein as having a flexible construct, it will also be appreciated that the conduit 290 may include other configurations that allow the conduit 290 to communicate with the lowest location in the shell assembly 12. In this regard, the conduit 290 may include at least one joint or hinge portion (not shown) that allows the conduit 290, or a portion thereof, to rotate in response to the effect of gravity on the rotation restricting device 292 and/or the conduit 290.

As illustrated in FIG. 3B, during operation, the compressor 10 may be rotated such that the axis 47 defines an angle $\alpha$ with a horizontal plane P. As the compressor 10 is rotated, the rotation restricting device 292 can urge the distal end 294 of the conduit 290 to the lowest (relative to the views in FIGS. 3A and 3B) location in the shell assembly 12, as previously described, and into fluid communication with the sump 26 and/or the lowest location in the shell assembly 12, such that the distal end 294 is disposed within the lubricant 27. In this regard, it will be appreciated that the rotation restricting device 292 can help the conduit 290 to remain in a vertical configuration, such that the conduit 290 forms an angle $\beta$ with the axis 47. The angle $\beta$ may be substantially equal to ninety degrees, less the angle $\alpha$. With the distal end 294 disposed within the lubricant 27, the pump assembly 20 can supply, or otherwise move, the lubricant 27 from the sump 26 and/or the lowest location in the shell assembly 12, through the conduit 290 and the pump assembly 220, and into the passageway 146, where it can then be delivered to the bearings 80, 82, the bushing 45, and/or other portions of the compressor 10 in the manner described above.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

What is claimed is:

1. A compressor comprising:
- a shell having a fluid disposed therein;
- a motor assembly disposed within the shell and drivingly engaged with a driveshaft;
- a compression mechanism driven by the driveshaft;
- a pump housing rotatably disposed within the shell for rotation relative to the driveshaft and relative to the shell; and
- at least one pump rotatably disposed within the pump housing such that the at least one pump is in driving engagement with the driveshaft.

2. The compressor of claim 1, further comprising a radially extending portion extending outwardly from the pump housing.

3. The compressor of claim 2, wherein the radially extending portion is at least partially disposed within the fluid.

4. The compressor of claim 1, wherein the at least one pump applies a first torque on the pump housing in a first direction, and the fluid applies a second torque on the pump housing in a second direction, the second direction being opposite the first direction.

5. The compressor of claim 1, wherein the pump housing is not supported by the shell.

6. The compressor of claim 1, wherein the motor assembly includes a flange disposed annularly about the driveshaft and supported by the motor assembly.

7. The compressor of claim 6, wherein the flange includes an axially extending portion and a radially inwardly extending portion.

8. A compressor comprising:
- a shell;
- a motor assembly disposed within the shell;
- a driveshaft drivingly engaged with the motor assembly;
- a compression mechanism driven by the driveshaft;
- a pump housing rotatably supported by the driveshaft for rotation relative to the driveshaft and relative to the shell; and
- a pump disposed within the pump housing and in driving engagement with the driveshaft.

9. A compressor comprising:
- a shell;
- a motor assembly disposed within the shell;
- a driveshaft drivingly engaged with the motor assembly;
- a pump assembly having a pump housing disposed within the shell and supported by the driveshaft, the driveshaft being rotatable relative to the pump housing and relative to the shell;
- a conduit having a first end and a second end, the first end coupled to the pump assembly; and
- a mass supported by the conduit near the second end.

10. The compressor of claim 9, further comprising lubricant disposed within an interior of the shell, the second end of the conduit being in fluid communication with the lubricant.

11. The compressor of claim 10, further comprising a sump housing the lubricant, the second end of the conduit being in fluid communication with an interior of the sump.

12. The compressor of claim 10, wherein when the compressor is rotated such that an axis extending a length of the driveshaft defines an angle with a horizontal plane, gravity acts on the mass, urging the second end of the conduit toward a lowest location within the shell, such that the second end of the conduit remains in fluid communication with the lubricant.

13. The compressor of claim 10, wherein when the compressor is rotated such that an axis extending a length of the driveshaft defines a first angle with a horizontal plane, gravity acts on the mass, urging a portion of the conduit in a vertical configuration such that the portion of the conduit forms a second angle with the axis extending the length of the driveshaft.

14. The compressor of claim 13, wherein when the conduit is in the vertical configuration, the second end of the conduit is in fluid communication with the lubricant such that the pump assembly moves the lubricant from the interior of the shell, through the conduit and the pump assembly, and into a passageway in the driveshaft.

15. The compressor of claim 13, wherein the second angle is equal to ninety degrees less the first angle.

16. The compressor of claim 9, wherein the conduit is flexible along its length.

17. The compressor of claim 9, wherein the conduit includes a hinged portion permitting one portion of the conduit to pivot relative to another portion of the conduit.

18. The compressor of claim 9, wherein the mass includes an aperture, and the second end of the conduit is inserted within the aperture and secured thereto.

19. The compressor of claim 9, wherein the driveshaft is rotatable within the pump housing.

20. The compressor of claim 9, wherein the mass is formed of metal.

* * * * *